US005963230A

United States Patent [19]

Higashino et al.

[11] Patent Number: 5,963,230

[45] Date of Patent: Oct. 5, 1999

[54] INKJET PRINTER AND INKJET PRINTING METHOD

[75] Inventors: Kusunoki Higashino, Osaka; Kenji Masaki, Nagaokakyo, both of Japan

[73] Assignee: Minolta Co., Ltd., Osaka, Japan

[21] Appl. No.: 08/900,993

[22] Filed: Jul. 25, 1997

[30] Foreign Application Priority Data

Jul. 25, 1996 [JP] Japan ..... 8-196098

[51] Int. Cl.[6] ..... B41J 2/21

[52] U.S. Cl. ..... 347/40; 347/15

[58] Field of Search ..... 347/15, 40

[56] References Cited

U.S. PATENT DOCUMENTS

| | | | |
|---|---|---|---|
| 5,208,605 | 5/1993 | Drake . | |
| 5,412,410 | 5/1995 | Rezanka | 347/15 |
| 5,648,801 | 7/1997 | Beardsley et al. | 347/15 |
| 5,751,310 | 5/1998 | Yano et al. | 347/15 |

FOREIGN PATENT DOCUMENTS 0437062 7/1991 European Pat. Off. .

*Primary Examiner*—N. Le
*Assistant Examiner*—Lamson D. Nguyen
*Attorney, Agent, or Firm*—Sidley & Austin

[57] ABSTRACT

An inkjet printer and inkjet printing method of the present invention discharges inks having different physical properties from a plurality of discharge nozzles. At the moment of discharge, the physical properties of an ink differ from the physical properties of an ink discharged from another nozzle. Specifically, a plurality of ink discharge nozzles individually communicate with separate ink reservoirs and inks having different physical properties may be supplied to said reservoirs, or supply inks having identical physical properties are supplied to said reservoirs and the physical properties of the inks accommodated in said reservoirs differ from the physical properties of inks accommodated in other reservoirs. That is, the differences in physical properties of the inks may be expressed as different discharge amounts when a uniform discharge force is exerted on the ink. When the discharge force is changed, ink drops of a size corresponding to said physical properties are discharged. Accordingly, when the physical properties of inks discharged from a plurality of nozzles are changed, there is an increase in the control range of the size of the ink drops that can be stably discharged, thereby producing a broader range of halftones.

33 Claims, 5 Drawing Sheets

RELATIONSHIP BETWEEN
SURFACE TENSION OF INK AND DOT SIZE

| SAMPLES / SURFACE TENSIONS σ (dyn/cm) / APPLIED VOLTAGES (V) | E | B | F | G |
|---|---|---|---|---|
| | 30 | 40 | 50 | 60 |
| 20 | 61 | 72 | 81 | – |
| 30 | 89 | 103 | 118 | 116 |
| 40 | 101 | 115 | 129 | 138 |

UNIT: μm

*FIG. 6*

RELATIONSHIP BETWEEN
INK VISCOSITY AND DOT SIZE

| SAMPLES / VISCOSITIES η (cp) / APPLIED VOLTAGES (V) | A | B | C | D |
|---|---|---|---|---|
| | 1.5 | 2.0 | 3.0 | 5.0 |
| 20 | 66 | 72 | 88 | 87 |
| 30 | 95 | 103 | 119 | 124 |
| 40 | 107 | 115 | 127 | 136 |

UNIT: μm

*FIG. 7*

COMPOSITION OF SAMPLES

| SAMPLES | A | B | C | D | E | F | G |
|---|---|---|---|---|---|---|---|
| SURFACE TENSIONS $\sigma$ (dyn/cm) | 40 | 40 | 40 | 40 | 30 | 50 | 60 |
| VISCOSITIES $\eta$ (cp) | 1.5 | 2.0 | 3.0 | 5.0 | 2.0 | 2.0 | 2.0 |
| $H_2O$ | 91 | 80 | 72 | 65 | 73 | 88 | 91 |
| DIETHYLENE GLYCOL | 6 | 11 | 10 | 8 | 16 | 6 | 2 |
| TRIETHYLENE GLYCOL MONOBUTYL ETHER | 0 | 6 | 5 | 5 | 8 | 3 | 4 |
| POLYETHYLENE GLYCOL | 0 | 0 | 10 | 19 | 0 | 0 | 0 |
| *SURFACTANT | 0 | 0 | 0 | 0 | 0.5 | 0 | 0 |
| DYE: DIRECT BLACK | 3 | 3 | 3 | 3 | 3 | 3 | 3 |

UNIT: wt%

(*) HYDROCARBON TYPE NONIONIC SURFACTANT: SANYOKASEI K.K. NONYPOL 200

INKJET PRINTER AND INKJET PRINTING METHOD

BACKGROUND OF THE INVENTION

The present invention relates to an inkjet printer and inkjet printing method, and more specifically relates to an inkjet printer and inkjet printing method wherein ink drops are discharged through a nozzle to form an image on a recording medium.

When forming high quality images by high-speed printing via inkjet recording methods, halftones can be effectively represented by changing the diameter of the print dots. Therefore, it is necessary to change the amount of ink discharged from the nozzle in accordance with the halftone level, and conventional methods are known wherein the amount of ink discharged from a nozzle is changed by changing the pressure exerted on the ink.

The amount of ink which can be stably discharged from the same nozzle and the variable range of the dot size formed by said discharged ink are limited, making it difficult to obtain images having sufficiently abundant halftones.

OBJECTS AND SUMMARY

In view of the aforesaid disadvantages, an object of the present invention is to provide an improved inkjet printer and inkjet printing method.

A further object of the present invention is to provide a novel inkjet printer and inkjet printing method capable of expressing a broad range of halftones.

The inkjet printer and inkjet printing method of the present invention discharges inks having different physical properties from a plurality of discharge nozzles. At the moment of discharge, the physical properties of an ink from one nozzle may differ from the physical properties of an ink discharged from another nozzle. Specifically, a plurality of ink discharge nozzles may individually communicate with separate ink reservoirs and inks having different physical properties may be supplied to said reservoirs, or supply inks having identical physical properties may be supplied to said reservoirs and the physical properties of the inks accommodated in said reservoirs may differ from the physical properties of inks accommodated in other reservoirs. That is, the differences in physical properties of the inks may be expressed as different discharge amounts when a uniform discharge force is exerted on the ink. When the discharge force is changed, ink drops of a size corresponding to said physical properties are discharged. Accordingly, when the physical properties of inks discharged from a plurality of nozzles are changed, there is an increase in the control range of the size of the ink drops that can be stably discharged, thereby producing a broader range of halftones.

The inkjet printer and inkjet printing method of the present invention modifies the physical properties of the ink discharged from nozzles. Thus, the physical properties of ink discharged from a nozzle can be modified, for example, in accordance with the halftones of an image being printed. Furthermore, modifiable physical properties of the ink include those that change the size of the ink drops discharged from the same nozzle, e.g., viscosity and surface tension. That is, the size of the ink drop may be adjusted by changing the physical properties of the ink. Therefore, it becomes possible to discharge ink drops of suitably different sizes from the same nozzle, thereby allowing the formation of images having abundant halftones.

The inkjet printer and inkjet printing method of the present invention use a first nozzle to discharge large ink drops and a second nozzle to discharge small ink drops, and increase the surface tension of the ink drops discharged from said first nozzle so as to be greater than the surface tension of the ink drops discharged from said second nozzle.

BRIEF DESCRIPTION OF THE DRAWINGS

These and other objects and features of the present invention will become apparent from the following description of a preferred embodiment thereof taken in conjunction with the accompanying drawings, in which:

FIG. 6 illustrates the change in drop size when the surface tension of the ink and the voltage applied to a piezoelectric element are changed under constant viscosity;

FIG. 7 illustrates the change in drop size when ink viscosity and the voltage applied to a piezoelectric element are changed under constant surface tension;

In the following description, like parts are designated by like reference numbers throughout the several drawings.

DETAILED DESCRIPTION OF THE PREFERRED EMBODIMENTS

The preferred embodiments are described hereinafter with reference to the accompanying drawings.

Figure 1:
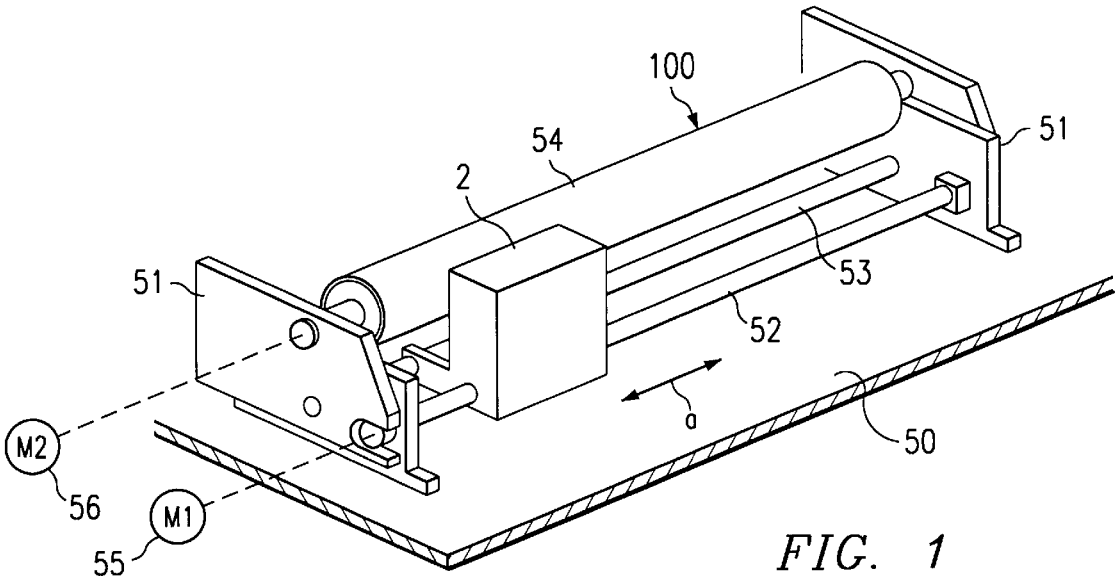
FIG. 1 is a perspective view of the main part of an inkjet printer.

FIG. 1 is a perspective view of the main part of an inkjet printer. As shown in FIG. 1, an inkjet printer 100 is provided with a base 50. A pair of side panels 51 are disposed in opposition one to another at predetermined spacing on base 50. A back-up roller 54, guide rod 53, and pole screw 52 are suspended in parallel array between the side panels 51. The back-up roller 54 and the pole screw 52 are supported on the side panels 51 so as to be rotatable, and are connected to drive motors 56 and 55, respectively. The guide rod 53 and pole screw 52 support a carriage 2.

The carriage 2 is provided with through-holes having a spiral channel provided therein, such that carriage 2 is capable of reciprocating movement in the arrow a direction guided by guide rod 53 in conjunction with the rotation of pole screw 52 via the engagement of pole screw 52 and the spiral channel provided in the through-holes when the pole screw 52 is inserted through the through-holes. The carriage 2 is provided with a printhead (fully described later) on the surface opposite the back-up roller 54. Printing of an image is accomplished by discharging ink drops from the printhead and adhering the discharged ink to a recording sheet transported thereto in conjunction with the rotation of the back-up roller 54. During a printing operation, a recording sheet is gradually transported in a direction perpendicular to the arrow a direction by back-up roller 54, and carriage 2 repeats a reciprocating movement in the arrow a direction to form an image of one picture part.

Figure 2:
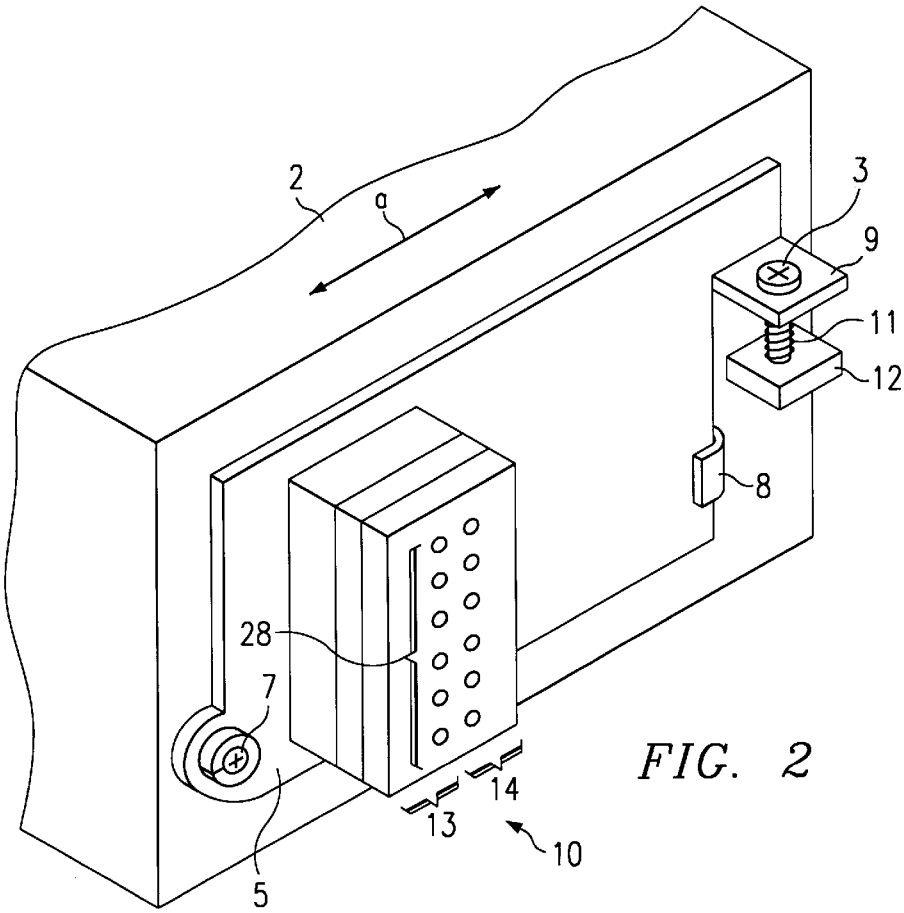
FIG. 2 is a perspective view showing the condition of a printhead supported by a carriage when viewing the carriage from the position of the back-up roller.

FIG. 2 is a perspective view showing the condition of a printhead 10 supported by the carriage 2 when viewing the carriage 2 from the direction of the back-up roller 54. As shown in FIG. 2, a regulating plate 5 is mounted on carriage 2 via a machine screw 7 so as to be rotatable. The edge of regulating plate 5 on the side opposite the machine screw 7 engages a receptor 8 protruding from carriage 2, such that the regulating plate 5 is pressed against the surface of carriage 2 facing back-up roller 54. A projection 9 bend in the direction of back-up roller 54 is provided on regulating plate 5, such that the tip of an adjustment screw 3 passing through the projection 9 is screwed into a threaded hole formed in a projection 12 protruding from carriage 2. A spring 11 is provided between projections 9 and 12 and exerts an upward force on projection 9. In this construction, it is possible to adjust the position of the printhead by adjusting the adjustment screw 3.

Figure 3:
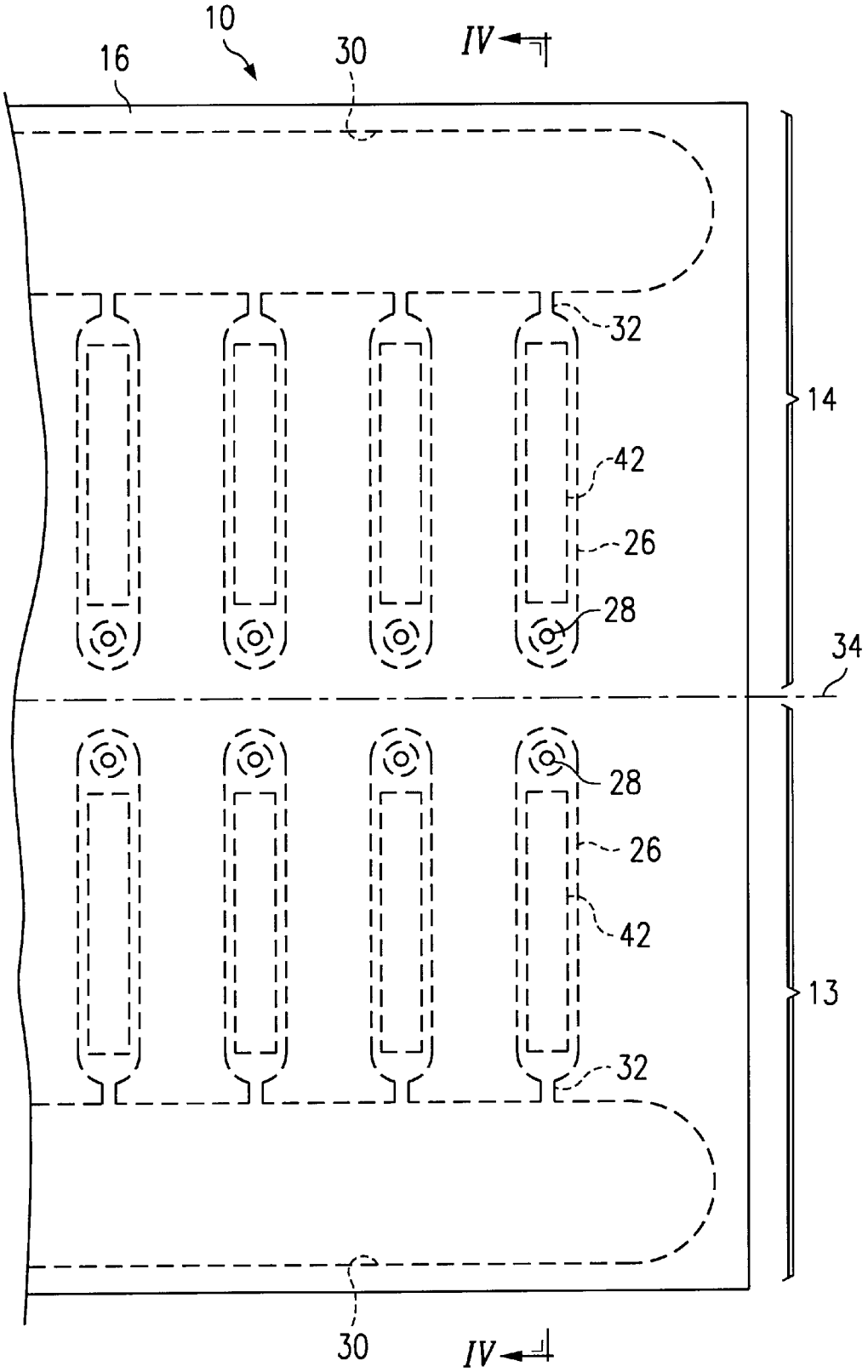
FIG. 3 is a plan view of a printhead.
Figure 4:
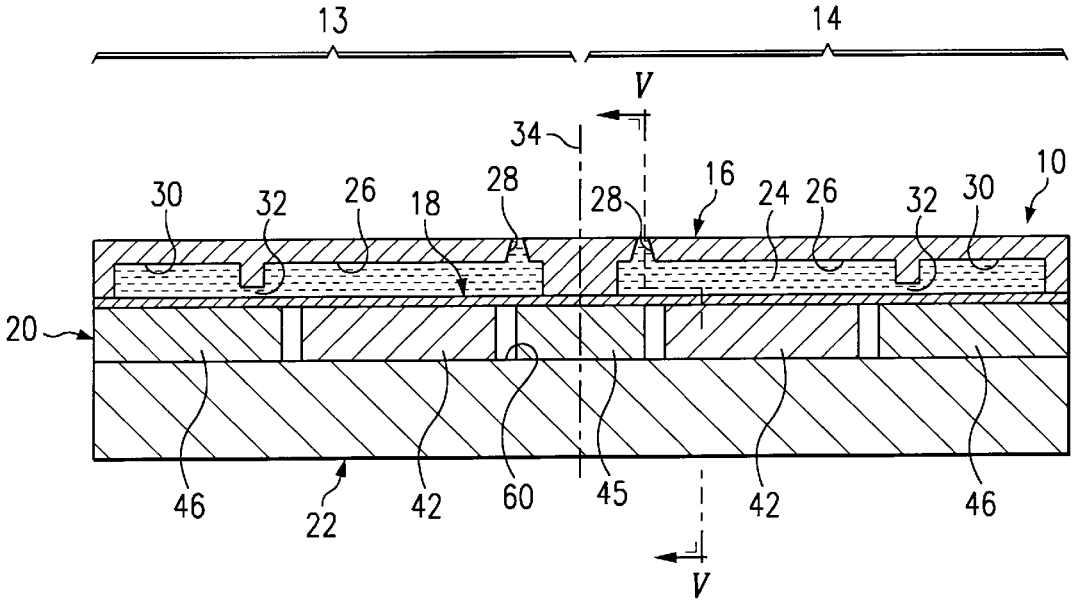
FIG. 4 is a section view on the IV—IV line of FIG. 3.
Figure 5:
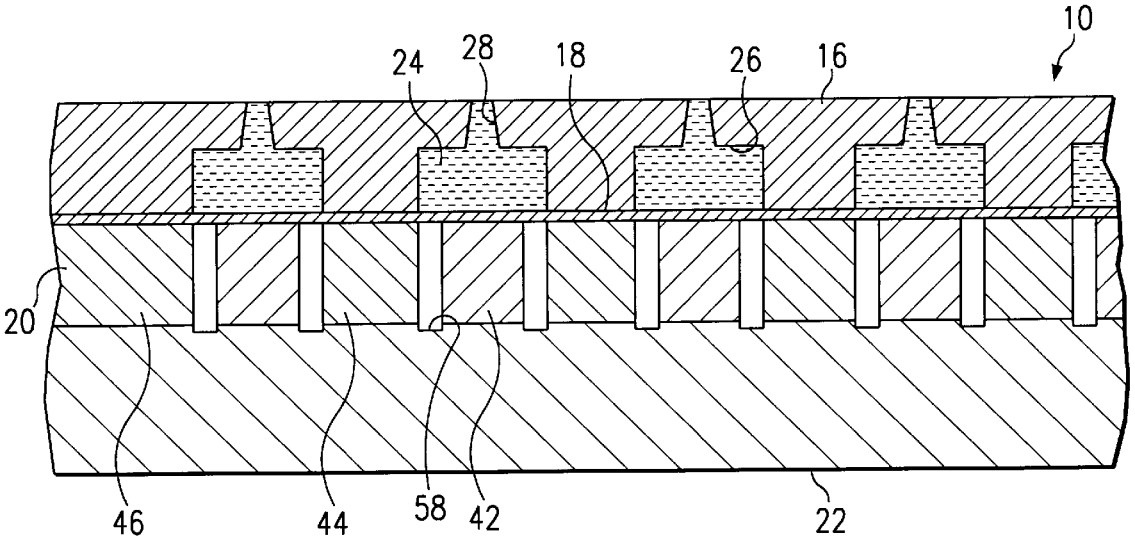
FIG. 5 is a section view on the V—V line of FIG. 4.

FIG. 3 is a plan view of printhead 10, FIG. 4 is a section view on the IV—IV line of FIG. 3, FIG. 5 is a section view on the V—V line of FIG. 4. The construction of printhead 10 is described below with reference to the aforesaid FIGS. 3 through 5.

Printhead 10 comprises a first head portion 13 to discharge large ink drops, and a second head portion 14 to discharge small ink drops. The first head portion 13 and the second head portion 14 are integratedly formed and overlaid on partition 18, oscillating layer 20, and substrate 22. (See FIG. 4)

A cover panel 16 is formed of metal or synthetic resin or the like, and is subjected to fine processing on the side confronting partition 18 via electroforming, photolithography or the like to form on the first head portion 13 and the second head portion 14 a plurality of ink cavities 26 to accommodate various inks 24, nozzles 28 to discharge ink 24 from the various cavities 26, ink supply reservoirs 30 to accommodate replenishment ink 24, and ink inlets 32 to connect the various ink cavities 26 to the ink reservoirs 30. As shown in FIG. 3, the ink cavities 26 of the first head portion 13 and the second head portion 14 are formed so as to be mutually parallel and extend in a direction toward head portion 13 and head portion 14. The ink reservoirs 30 are formed on bilateral sides and are centered on center line 34 medial to ink cavities 26, and are connected to an ink tank not shown in the illustrations. In the present embodiment, the nozzle 28 of the first head portion 13 and the nozzle 28 of the second head portion 14 have identical nozzle diameters.

Partition 18 may be a thin film formed of metal or synthetic resin, and is fixedly attached between cover panel 16 and oscillating layer 20. It is desirable that partition 18 is fixedly attached under the application of a predetermined tension.

Oscillating layer 20 comprises a well known piezoelectric material, the top and bottom surfaces of which are provided with a common electrode, and a conductive metal layer (not shown) used as a individual electrode, and is fixedly mounted between partition 18 and substrate 22. The common electrodes and individual electrodes are connected to a print signal control circuit (not illustrated), and a predetermined voltage is applied between said common electrodes and said individual electrodes. The electrode pull out method of the electrodes may utilize various methods and are not particularly restricted, e.g., the electrodes may be pulled out by using a conductive material to use the partition 18 as a common electrode, and patterning a individual electrode on the surface of substrate 22. The oscillating layer 20 is divided into vertical channels 58 and horizontal channels 60 via a dicing process, and provided with piezoelectric member 42 corresponding to each ink cavity 26, partitions 44 positioned between adjacent piezoelectric members 42, partitions 45 positioned between mutually confronting piezoelectric members 42, and elements are separated by a circumscribing wall 46. The piezoelectric members 42 are polarized via the application of a high voltage between the common electrode and individual electrode of the top and bottom surfaces under high temperature. The piezoelectric members 42 may have a monolayer construction, or may have a laminate construction comprising a plurality of overlaid piezoelectric materials and electrodes.

The substrate 22 is formed of metal or synthetic resin or the like, and is fixedly attached to the oscillating layer 20 via adhesive.

In printhead 10 of the aforesaid construction, ink 24 is supplied from an ink tank (not illustrated) to ink reservoirs 30. The ink 24 supplied to the ink reservoir 30 of the first head portion 13 has a higher viscosity, or higher surface tension, or both relative to the ink 24 supplied to the ink reservoir 30 of the second head portion 14. The ink 24 accommodated in ink reservoirs 30 is supplied into the various ink cavities 26 via ink inlets 32. When a predetermined voltage (i.e., print signal) is transmitted from the print signal control circuit (not shown) and applied between the common electrode and the individual electrode, the piezoelectric member 42 is deformed toward the ink cavity 26. The deformation of the piezoelectric member 42 is transmitted to the partition 18, thereby applying pressure on the ink 24 accommodated within the ink cavity 26 and causing ink drops to discharge through ink nozzle 28. Since the ink 24 accommodated in the first head portion 13 has a higher viscosity or higher surface tension or both relative to the ink 24 accommodated in the second head portion 14 at this time as previously described, large ink drops are discharged from the first head portion 13 and small ink drops are discharged from the second head portion 14. Furthermore, the size of the ink drops discharged from the first head portion 13 and the second head portion 14 can be modified by changing the voltage value and application time of the signal voltage applied between the common electrode and the individual electrode in accordance with the image signals. Therefore, the halftone range can be broadened by suitably selecting the first head portion 13 and second head portion 14, and changing the voltage applied between the common electrode and the individual electrodes in accordance with the conditions of an image to be printed. Although the nozzle 28 of the first head portion 13 and the nozzle 28 of the second head portion 14 have identical nozzle diameters in the present embodiment, the reproducible halftone range may be enlarged if the nozzle 28 of the first head portion 13 has a larger diameter than the nozzle 28 of the second head portion 14.

Various types of conventional and well known inkjet recording inks may be used as the ink used in the aforesaid printhead 10. For example, aqueous inks comprising water-soluble dyes, water soluble organic solvents, surface active agents and the like may be used.

Conventional well-known acidic dyes, direct dyes, basic dyes, reactive dyes and the like may be used as the aforesaid water soluble dyes.

Various organic solvents may be used as the aforesaid water-soluble organic solvents for the purpose of adjusting dryness, moisture retention, viscosity, surface tension and the like. Examples of usable solvents include monovalent alcohols such as methanol, ethanol and the like, polyalkaline glycols such as polyethylene glycol, polypropylene glycol and the like, polyvalent alcohols such as ethylene glycol, propylene glycol, diethylene glycol, triethylene glycol, glycerine and the like, polyvalent alcohol ethers such as triethylene glycol monobutyl ether, diethylene glycol monobutyl ether and the like, and cyclic amides such as 2-pyrrolidone, 1-methyl-2-pyrrolidone and the like. The use of the aforesaid polyalkaline glycols, polyvalent alcohols, and polyvalent alcohol ethers are particularly desirable to regulate viscosity and surface tension.

Various surface active agents such as nonionic agents, anionic agents, cationic agents and the like may be used as the aforesaid surface active agents for the purpose of preventing the ink from running, and improving ink dischargeability.

Other additive such as pH control agents, amphipatic agents, chelating agents, anti-corrosion agents, mildew-proofing agents, quenching agents, oxygen absorbing agents, and other viscosity regulating agents, and surface tension regulating agents may be added as needed.

Ink viscosity adjustment may be accomplished by adjusting the type and amount of added water-soluble organic solvent and viscosity regulating agent. Surface tension adjustment may be accomplished by adjusting the type and amount of added water-soluble organic solvent, surface tension regulating agent, and surface active agent. In general, adding water increases surface tension, and adding surface active agent reduces surface tension.

Specific experimental examples are described below.

(1) Experiment 1

The relationship between the surface tension of the ink and the ink drop size was investigated by experiment. The inkjet recording head used in example 1 had a nozzle diameter of 35 μm. Four types aqueous inks (samples E, B, F, and G) having different surface tensions (i.e., s=30, 40, 50, 60 dyn/cm) were produced using the compositions shown in FIG. 8. The viscosity of the inks was uniform (i.e., h=2.0 cp). The piezoelectric member was a laminate type member comprising 28 overlaid layers of piezoelectric sheets having a thickness of 30 μm. Using the aforesaid four types of ink, pulses (rise time and fall time: 5 μsec; pulse width 20 μm) of three types of voltages (i.e., V=20, 30, 40 V) were applied between the common electrode and individual electrode, and the size of the ink dot adhered to a recording medium was measured. Results are shown in FIG. 6.

It can be understood from FIG. 6 that the size of the ink dot (i.e., the ink drop) increases in conjunction with an increase in the surface tension and applied voltage. Although the dot size only changed from 72 to 115 μm when using only an ink having a surface tension of s=40 dyn/cm even when the voltage was varied, if an ink having a surface tension of s=30 dyn/cm is used in the second head portion and an ink having a surface tension of s=60 dyn/cm is used in the first head portion, it is possible to have an inkjet recording head capable of discharging ink drops from 61 to 138 μm, thereby achieving broad dot size modulation.

(2) Experiment 2

The relationship between ink viscosity and dot size was investigated by experiment. The inkjet recording head used in example 2 had a nozzle diameter of 35 μm. Four types of aqueous inks (samples A, B, C, D) having different viscosities (i.e., h=1.5, 2.0, 3.0, 5.0 cp) were produced using the compositions shown in FIG. 8. The surface tension of the inks was uniform (i.e., s=40 dyn/cm). The piezoelectric member was a laminate type member comprising 28 overlaid layers of piezoelectric sheets having a thickness of 30 μm. Using the aforesaid four types of ink, pulses (rise time and fall time: 5 μsec; pulse width 20 μm) of three types of voltages (i.e., V=20, 30, 40 V) were applied between the common electrode and individual electrode, and the size of the ink dot adhered to a recording medium was measured. Results are shown in FIG. 7.

It can be understood from FIG. 7 that the size of the ink dot (i.e., the ink drop) increases in conjunction with an increase in the surface tension and applied voltage. Although the dot size only changed from 72 to 115 μm when using only an ink having a viscosity of h=2.0 cp even when the voltage was varied, if an ink having a viscosity of h=1.5 cp is used in the second head portion and an ink having a viscosity of h=5.0 cp is used in the first head portion, it is possible to have an inkjet recording head capable of discharging ink drops from 61 to 138 μm, thereby achieving broad dot size modulation.

Figures 8, 9:
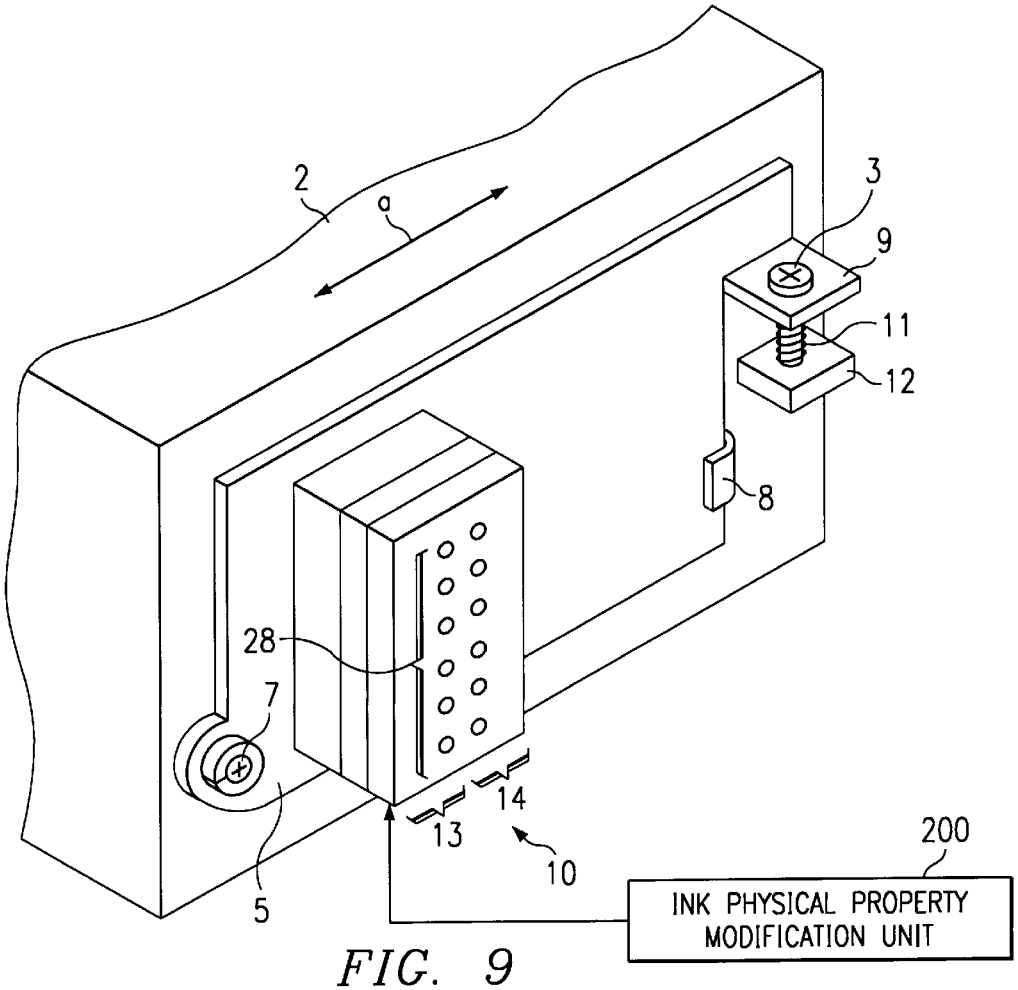
FIG. 8 shows the compositions of inks used in experiments.
FIG. 9 shows a second embodiment of a printhead.

The compositions of samples A through G used in experiments 1 and 2 are shown in the table of FIG. 8.

Although an ink having high viscosity and high surface tension was used in the first head portion in the description above, it is to be noted that the loss factor increases as the viscosity and surface tension increase because flow resistance increases as the nozzle diameter becomes smaller such that surface tension resistance increases relative to the force of ink discharge. Accordingly, using an ink having lower viscosity and surface tension in the first head portion than the ink in the second head portion may be considered. Rather than supplying ink having different physical properties to the first and second head portions, an ink physical property modification unit 200 may be provided. In this case, ink having identical physical property may be supplied to both head portions, and physical property of the ink accommodated in the ink supply reservoir or ink cavity is modified by said ink physical property modification unit 200.

Specifically, the ink physical property modification unit 200 is provided with a container accommodating a viscosity regulating agent or a surface tension regulating agent and a pump to supply the fluid from said container, and adds said viscosity regulating agent or said surface tension regulating agent to the ink when the ink is supplied from the ink tank to the ink reservoir. Of course, water soluble organic solvent or surface active agent having a viscosity regulating action or surface tension regulating action may be used alternatively.

The ink physical property modification unit 200 may provide heaters on the various ink reservoirs, ink cavities, or nozzles so as to adjust the viscosity and surface tension of the ink by changing the temperature of the discharging ink. For example, it was verified by experiment that when an ink having a viscosity of 5 cp (sample D above) at 25° C. is heated to a temperature of 40° C., the viscosity is reduced to 2.1 cp.

Furthermore, when a piezoelectric material is used which produces a temperature rise when a high voltage, i.e., a voltage of high frequency, is applied to said piezoelectric member so as to change the physical property of the ink, the physical property of the ink may be modified by heat generated by the ink physical property modification unit 200 by actuating the piezoelectric member before the ink is discharged. The present inventors have found through experimentation that although the surface temperature of a piezoelectric member rises only about +3° C. when driven under normal conditions (i.e., 30 V, 5 kHz), the surface temperature of the piezoelectric member can be raised about +25° C. to about 50° C. by applying a pulse at 50 V and 10 kHz with a rise time of less than 1 μsec.

The inkjet recording head is provided with two head portions in the previously described embodiments, but it is to be understood that when an ink physical property modification unit 200 is provided to modify the physical property of the discharging ink as described above, the size of discharged ink drops and the size of the dots formed by said drops may be suitably modified as needed by provided only a single head portion.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An inkjet printer comprising:

a plurality of ink discharge nozzles from which ink are discharged onto a recording medium for forming images, said ink discharged from each of said plurality of ink discharge nozzles having substantially the same color;

wherein a physical property of ink discharged from one of said plurality of ink discharge nozzles is different from a physical property of ink discharged from another one of said plurality of ink discharge nozzles, said physical property including at least one of viscosity and surface tension;

wherein as a result of said physical property difference between said ink discharged from said one of said plurality of ink discharge nozzles and said ink discharged from said another one of said plurality of ink discharge nozzles, a size of an ink drop discharged from said one of said plurality of ink discharge nozzles and a size of an ink drop discharged from said another one of said plurality of ink discharge nozzles are different.

2. An inkjet printer in accordance with claim 1 further comprising:

a plurality of ink reservoirs at least one of which contains ink having a different physical property than ink contained in others of said plurality of ink reservoirs, one of said plurality of ink reservoirs being in communication with each one of said plurality of ink discharge nozzles.

3. An inkjet printer in accordance with claim 1 further comprising:

a plurality of ink cavities each of which is in communication with one of said plurality of ink discharge nozzles;

a plurality of ink reservoirs each of which contains ink having substantially identical physical properties, each of said plurality of ink reservoirs being in communication with one of said plurality of ink cavities; and an ink physical property modification device which modifies the physical property of the ink in at least one of said ink cavities so that, at the moment of discharge, the physical property of ink discharged from said one of said plurality of ink discharge nozzles is different from the physical property of ink discharged from another one of said plurality of ink discharge nozzles.

4. An inkjet printer in accordance with claim 1, wherein a viscosity of an ink discharged from one of said plurality of ink discharge nozzles is different from a viscosity of an ink discharged from another one of said plurality of ink discharge nozzles.

5. An inkjet printer in accordance with claim 1, wherein a surface tension of an ink discharged from one of said plurality of ink discharge nozzles is different from a surface tension of an ink discharged from another one of said plurality of ink discharge nozzles.

6. An inkjet printer in accordance with claim 1, wherein said plurality of ink discharge nozzles include a first nozzle to discharge large ink drops and a second nozzle to discharge small ink drops.

7. An inkjet printer in accordance with claim 6, wherein a viscosity of an ink discharged from said first nozzle is higher than a viscosity of an ink discharged from said second nozzle.

8. An inkjet printer in accordance with claim 6, wherein a surface tension of an ink discharged from said first nozzle is higher than a surface tension of an ink discharged from said second nozzle.

9. A printing method used in an inkjet printer comprising steps of:

discharging ink drops having large diameter in accordance with image data;

discharging ink drops having small diameter in accordance with image data;

wherein said ink drops having large diameter and said ink drops having small diameter have substantially the same color; and wherein a physical property of the ink drops having large diameter is different from a physical property of the ink drops having small diameter, said physical characteristic including at least one of viscosity and surface tension.

10. An printing method in accordance with claim 9, wherein a viscosity of said ink drops having large diameter is higher than a viscosity of said ink drops having small diameter.

11. An printing method in accordance with claim 9, wherein a surface tension of said ink drops having large diameter is higher than a surface tension of said ink drops having small diameter.

12. An printing method in accordance with claim 9, wherein said ink drops having large diameter are discharged from a first nozzle and said ink drops having small diameter are discharged from a second nozzle, a nozzle diameter of said first nozzle being different than a nozzle diameter of said second nozzle.

13. An ink-jet recording head for use in an ink-jet printer, comprising:

a plurality of head portions, each of said head portions including an ink cavity for receiving an ink material, a piezoelectric member for pressurizing said ink material in said ink cavity, and a nozzle through which said pressurized ink material is ejected;

wherein said ink material in each of said ink cavities has substantially the same color, and wherein said ink material in one of said plurality of ink cavities has a physical characteristic different than a physical characteristic of said ink material in another one of said plurality of ink cavities, said physical characteristic including at least one of viscosity and surface tension; and a drive circuit to apply a voltage to a selected one of the piezoelectric members to discharge an ink drop from a corresponding one of said nozzles;

wherein as a result of said physical characteristic difference between said ink material in said one of said plurality of ink cavities and said ink material in said another one of said plurality of ink cavities, a size of an ink drop discharged from a nozzle corresponding to said one of said plurality of ink cavities and a size of an ink drop discharged from a nozzle corresponding to said another one of said plurality of ink cavities are different.

14. An ink-jet recording head in accordance with claim 13, wherein said nozzle corresponding to said one of said plurality of ink cavities and said nozzle corresponding to said another one of said plurality of ink cavities have a substantially identical nozzle diameter.

15. An ink-jet recording head in accordance with claim 13, wherein said nozzle corresponding to said one of said plurality of ink cavities and said nozzle corresponding to said another one of said plurality of ink cavities have a different nozzle diameter.

16. An ink-jet recording head in accordance with claim 13, further including an ink material heater to heat said ink material in said one of said plurality of ink cavities so that said ink material in said one of said plurality of ink cavities has a different temperature than said ink material in said another one of said plurality of ink cavities.

17. An ink-jet recording head in accordance with claim 16, wherein said ink cavity for each of said plurality of head portions receives substantially identical ink material and said physical characteristic difference between said ink material in said one of said plurality of ink cavities and said ink material in said another one of said plurality of ink cavities is generated by said ink material heater.

18. An ink-jet recording head in accordance with claim 17, wherein said ink cavity for each of said plurality of head portions receives substantially identical ink material from a common ink reservoir.

19. An ink-jet recording head in accordance with claim 13, further including a device for delivering an ink material physical characteristic modifying substance to at least one of said ink cavities so that a physical characteristic of said ink material delivered to said ink cavity can be modified in said ink cavity by the thus delivered ink material physical characteristic modifying substance.

20. An ink-jet recording head in accordance with claim 19, wherein said ink cavity for each of said plurality of head portions receives substantially identical ink material from a common ink reservoir and said physical characteristic difference between said ink material in said one of said plurality of ink cavities and said ink material in said another one of said plurality of ink cavities is generated by the thus delivered ink material physical characteristic modifying substance.

21. An ink-jet recording head in accordance with claim 19, wherein said ink material physical characteristic modifying substance includes at least one of a viscosity regulating agent and a surface tension regulating agent.

22. An ink-jet recording head for use in an ink-jet printer, comprising:

a plurality of head portions, each of said head portions including an ink cavity for receiving an ink material, a piezoelectric member for pressurizing said ink material in said ink cavity, and a nozzle through which said pressurized ink material is ejected;

wherein said ink material in each of said ink cavities has substantially the same color, and wherein said ink material in one of said plurality of ink cavities has a physical characteristic different than a physical characteristic of said ink material in another one of said plurality of ink cavities, said physical characteristic including at least one of viscosity and surface tension; and a drive circuit to apply a voltage to a selected one of the piezoelectric members to discharge an ink drop from a corresponding one of said nozzles, said applied voltage having a variable amplitude so that a size of said ink drop discharged can be controlled thereby;

wherein as a result of said physical characteristic difference between said ink material in said one of said plurality of ink cavities and said ink material in said another one of said plurality of ink cavities, a first range of sizes of ink drops can be discharged from a nozzle corresponding to said one of said plurality of ink cavities and a second range of sizes of ink drops can be discharged from a nozzle corresponding to said another one of said plurality of ink cavities, said first range of sizes being different than said second range of sizes.

23. A method of printing with an ink-jet recording head in an ink-jet printer, comprising the steps of:

providing a first ink material;

providing a second ink material, said first and second ink materials having substantially the same color, said first ink material having a physical characteristic different than a physical characteristic of said second ink material, said physical characteristic including at least one of viscosity and surface tension;

ejecting a first ink drop of said first ink material through a first nozzle by applying a first discharge force to a first ink cavity;

ejecting a second ink drop of said second ink material through a second nozzle by applying a second discharge force to a second ink cavity;

wherein as a result of said physical characteristic difference between said first ink material and said second ink material said first ink drop and said second ink drop have different sizes.

24. A method of printing with an ink-jet recording head in accordance with claim 23, wherein said first and second nozzles have substantially identical nozzle diameters and said first and second discharge forces are substantially equal.

25. An ink-jet recording head for use in an ink-jet printer, comprising:

an ink cavity for receiving an ink material from an ink reservoir, said ink material having a physical characteristic including at least one of viscosity and surface tension;

a piezoelectric member for pressurizing said ink material in said ink cavity;

a nozzle through which said pressurized ink material is ejected;

a device for selectively modifying said physical characteristic of said ink material received in said ink cavity; and a drive circuit to apply a voltage to said piezoelectric member to discharge an ink drop having a selectively modified physical characteristic from said nozzle;

wherein a size of ink drop discharged as a result of said applied voltage varies with said selective modification of said physical characteristic.

26. An ink-jet recording head in accordance with claim 25, wherein said device for selectively modifying said physical characteristic of said ink material received in said ink cavity includes a device for delivering an ink material physical characteristic modifying substance to said ink cavity so that said physical characteristic of said ink material delivered to said ink cavity can be modified.

27. An ink-jet recording head in accordance with claim 26, wherein said ink material physical characteristic modifying substance includes at least one of a viscosity regulating agent and a surface tension regulating agent.

28. An ink-jet recording head in accordance with claim 27, wherein said applied voltage has a variable amplitude so that a size of said ink drop discharged can be additionally controlled thereby.

29. An ink-jet recording head in accordance with claim 25, wherein said device for selectively modifying said physical characteristic of said ink material received in said ink cavity includes an ink material heater to selectively heat said ink material in said ink cavity.

30. A method of printing with an ink-jet recording head comprising the steps of:

receiving an ink material from an ink reservoir into an ink cavity, said ink material as received from said ink reservoir having a physical characteristic including at least one of viscosity and surface tension;

pressurizing said ink material;

selectively modifying said physical characteristic of said ink in said ink cavity so that said physical characteristic of said ink as modified is different than said physical characteristic of said ink material as received from said ink reservoir;

discharging said ink material through a nozzle;

wherein a size of ink drop discharged as a result of said step of pressuring said ink material varies with said selective modification of said physical characteristic.

31. An ink-jet recording head in accordance with claim 30, wherein said step of selectively modifying said physical characteristic of said ink material received in said ink cavity includes the step of delivering an ink material physical characteristic modifying substance to said ink cavity so that said physical characteristic of said ink material is thereby modified.

32. An ink-jet recording head in accordance with claim 31, wherein said step of delivering an ink material physical characteristic modifying substance to said ink cavity includes the step of delivering at least one of a viscosity regulating agent and a surface tension regulating agent.

33. An ink-jet recording head in accordance with claim 30, further comprising the step of heating said ink material in said ink cavity to change a temperature thereof.

* * * * *

UNITED STATES PATENT AND TRADEMARK OFFICE

CERTIFICATE OF CORRECTION

PATENT NO. : 5,963,230
DATED : October 5, 1999
INVENTOR(S) : Kusunoki HIGASHINO et al.

It is certified that error appears in the above-indentified patent and that said Letters Patent is hereby corrected as shown below:

Column 7, line 18, delete "are" and insert -is--.

Column 7, line 64, delete "an".

Column 7, line 66, delete "an".

Column 8, line 2, delete "an".

Column 8, line 4, delete "an".

Column 8, line 11, delete "an".

Column 8, line 12, delete "an".

Column 8, line 15, delete "an".

Column 8, line 16, delete "an".

Column 8, line 18, delete "used" and insert --for use--.

UNITED STATES PATENT AND TRADEMARK OFFICE

CERTIFICATE OF CORRECTION

PATENT NO. : 5,963,230
DATED : October 5, 1999
INVENTOR(S) : Kusunoki HIGASHINO et al.

It is certified that error appears in the above-indentified patent and that said Letters Patent is hereby corrected as shown below:

Column 8, line 32, delete "An" and insert --A--.

Column 8, line 36, delete "An" and insert --A--.

Column 8, line 40, delete "An" and insert --A--.

Signed and Sealed this

Third Day of April, 2001

*Attest:*

Nicholas P. Godici

NICHOLAS P. GODICI

*Attesting Officer*

*Acting Director of the United States Patent and Trademark Office*